United States Patent [19]

Bednarz

[11] Patent Number: 4,574,881

[45] Date of Patent: Mar. 11, 1986

[54] SPLIT NUT IN BLOWOUT PREVENTER

[76] Inventor: James W. Bednarz, 1025 W. Crosby, Slaton, Tex. 79364

[21] Appl. No.: 700,715

[22] Filed: Feb. 12, 1985

[51] Int. Cl.[4] ..... B32B 31/00; G01M 1/00

[52] U.S. Cl. ..... 166/75.1; 29/450; 29/463; 29/526 R; 74/127; 251/1.3; 411/432

[58] Field of Search ..... 29/463, 526 R, 451; 251/1.3; 403/8; 74/127; 166/75 R; 411/432

[56] References Cited

U.S. PATENT DOCUMENTS

| | | | |
|---|---|---|---|
| 667,277 | 2/1901 | Williams | 411/432 X |
| 1,675,326 | 7/1928 | Blanding | 74/127 X |
| 1,989,429 | 1/1935 | Segelhorst et al. | 251/1.1 X |
| 2,291,846 | 8/1942 | Taylor | 403/8 |
| 2,881,997 | 4/1959 | McMahan, Sr. | 166/75 X |
| 2,897,895 | 8/1959 | Ortloff | 166/75 X |
| 3,731,504 | 5/1973 | Belknap | 411/432 X |
| 3,799,292 | 3/1974 | Katz | 411/432 X |
| 3,941,141 | 3/1976 | Robert | 251/1.3 X |
| 4,290,577 | 9/1981 | Olson | 251/1.1 |
| 4,398,729 | 8/1983 | Bishop | 251/1.3 X |

*Primary Examiner*—Charlie T. Moon

*Attorney, Agent, or Firm*—Montgomery W. Smith; Wendell Coffee

[57] ABSTRACT

An improved split nut for use in blowout preventers temporarily installed on oil or gas wells is formed by fastening a base and a cap together. Fastening bolts are inserted through holes in the cap and in packing inserts in the base, and threaded into fastening nuts positioned within recesses in the base. Plugs seal the recesses from corrosive materials and hold the fastening nuts in position for convenient assembly. The packing inserts are compressed when the fastening nuts and bolts are tightened to seal the threads of the fastening bolts and nuts from corrosive materials that may seep through the cap holes.

8 Claims, 8 Drawing Figures

SPLIT NUT IN BLOWOUT PREVENTER

BACKGROUND OF THE INVENTION:

(1) Field of the Invention

This invention relates to split nuts used in blowout preventers temporarily installed on oil and gas wells. Applicant designates one with ordinary skill in the art as a mechanical engineer, or person having similar experience and training, engaged in the manufacture or repair of blowout preventers.

The blowout preventer art is a specialized area of the oil and gas well drilling and reworking fields. Problems are experienced in the design and construction of blowout preventers that are not encountered in other areas. Therefore, those with ordinary skill tend to restrict their search for solutions to the teachings of the existing blowout preventer art. Thus, applicant asserts that the pertinent art is limited to references relating to blowout preventers.

(2) Description of the Prior Art

During drilling, reworking or reentry operations, the well bore and well head may be highly pressurized, either by penetrating a pressurized reservoir or by intentionally applied mechanical forces. To contain these pressures reliably, blowout preventers are installed to block the well bore when necessary.

There are different types and designs of blowout preventers. Several designs incorporate "split nuts", or "brass nuts", and are the only blowout preventers that concern this invention. The remaining blowout preventers do not use split nuts of the type that my invention improves.

Blowout preventers that include split nuts typically include carriages that have sealing surfaces that mate with a round tube or drill string within the blowout preventer bore, or that include a "blind", to seal the blowout preventer bore. The split nuts are attached to the carriages. Actuating screws, journaled within the blowout preventer, are rotated to thread the split nuts, and hence the carriages along the screws to slide the carriages together.

The blowout preventers with split nuts are sometimes used with drilling operations, but are temporarily installed on wells during reworking or reentry operations. During such operations the entire system, or part thereof, may be intentionally pressurized, and acid, mud, cement, salt water, sand, or other media may be introduced through a tube within the preventer bore, or through a side port that is normally plugged when a "blind" is used to completely block or seal the bore, during acidizing, fracturizing, and recirculation operations.

The split nuts described thus far, used extensively and well known by workers in the well treatment arts, have been formed of brass, and are split into a cap and a base fastened together to form a threaded nut bore. Prior art split nuts, were made of brass and are also commonly referred to as "brass nuts", "brass", or "split nuts".

One problem experienced in the prior art is that the base and cap of the brass nuts were fastened together by steel bolts threaded into threaded holes in the brass base. For various reasons, such as the effects of corrosive materials used with blowout preventers, overtightening during assembly, wear and tear due to repeated disassembly and assembly encountered in cleaning and redressing the carriage sealing surfaces, or failure during use, the brass threads in the base into which the fastening bolts are tightened are stripped out. Of course, the brass or split nut can fail in other ways, such as splitting or cracking of the base, or simply wearing out the threads in the split nut bore. As between failure of the split nut and damage of the carriage or actuating screw, failure of the split nut is preferred. Therefore, the split nut is designed to fail before the carriage or actuating screws, so that the split nut acts as a "fuze".

Prior to my invention, brass nuts with stripped or damaged threads for fastening bolts, as well as those failed in other ways, were usually discarded and replaced with a new brass nut. Another problem encountered while using blowout preventers was corrosion of the fastening bolt threads and the bolt holes in the bore as corrosive materials seeped down the bolts past the holes in the cap.

Prior to filing this application, a search was made in the United States Patent and Trademark Office. That search developed the following United States Patents:

KOHN, U.S. Pat. No. 296,336; MATTHEWS, U.S. Pat. No. 354,331; TAYLOR, U.S. Pat. No. 2,291,846; BELKNAP, U.S. Pat. No. 3,731,504.

The patents developed during the search do not appear to applicant to be particularly pertinent to the limited subject matter of this application. However, applicant has provided citations thereof in the event that, as the product of the efforts of an experienced searcher, the Examiner might find them of interest.

SUMMARY OF THE INVENTION (1) New Function and Unexpected Results

The improved split nut of my invention incorporates recesses, and a fastening nut that is positioned within the recesses and then threaded on the fastening bolts to fasten the cap to the base. The fastening nut could be specifically designed to fail under a predetermined load. The recess is sized to prevent turning of the fastening nut during threading of the bolt. Additionally, fastening nuts with stripped or damaged threads may be quickly and easily replaced, contrary to the prior art practice of discarding units with stripped bolt holes in the brass base.

My invention also uses plugs to seal the recesses from grit, dirt, and corrosive agents that might cause premature failure of the fastening nut. The plugs preferably completely fills the recesses except for the space occupied by the fastener nuts and bolts. The fastening nuts may therefore be conveniently positioned in the plugs, with the fastening nuts aligned with the cap and base holes for quick threading of the fastening bolts.

My invention further isolates the threads of the fastening bolts and nuts from corrosive materials by using a packing insert within the holes in the base about the fastening bolt. The packing insert is preferably made of rubber or other resilient material that is compressed by tightening of the fastening bolts and nuts, thus sealing the threads from corrosive materials.

Thus, my invention produces the unexpected results of a split nut that is easily repaired or replaced, and that is less subject to failure due to corrosion.

(2) Objects of the Invention

An object of this invention is the quick and convenient repair or replacement of a split nut in a blowout preventer.

Another object of this invention is increased serviceability of the blowout preventer when used for rework and reentry operations.

Further objects are to achieve the above with a device that is sturdy, compact, durable, lightweight, simple, safe, efficient, ecologically compatible, energy conserving, and reliable, yet inexpensive and easy to manufacture, assemble, install, operate and repair.

Other objects are to achieve the above with a method that is versatile, ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not scale drawings.

Figure 1:
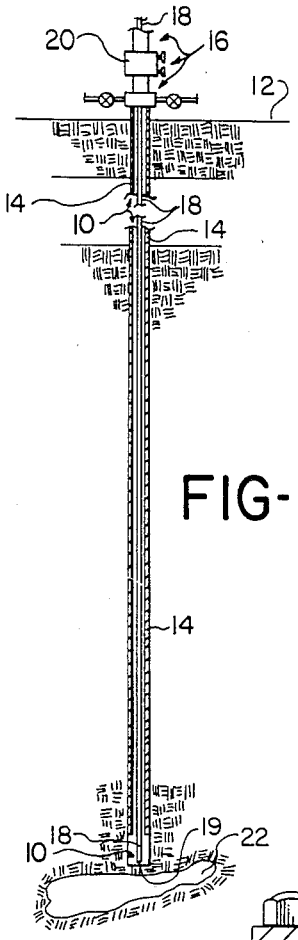
FIG. 1 is a schematic diagram of a well with a blowout preventer attached that uses a split nut according to my invention.

DESCRIPTION OF THE PREFERRED EMBODIMENT:

My invention is used in a blowout preventer temporarily installed on an oil or gas well, referred to in the claims as a "well". As schematically shown in FIG. 1, a typical well on which a blowout preventer is installed includes, among other structure, well bore 10 extending from ground surface 12 to deep below the ground surface. For at least a portion of its depth, the well bore 10 has casing 14 therein. Atop the casing 14 and above the ground surface is well head 16.

Tubing string 18 extends through and within the well head 16 and casing 14 toward well bore bottom 19. As used herein, the "tubing string" may include any string of elongated tubing or rodding, extended through the well head, and depended within the well bore, with drill bits or reworking tools at the end thereof. Some reworking operations are performed with no tubing string extending through the bores of the well and well head. Those with ordinary skill in the pertinent art will be familiar with the circumstances in which blowout preventers are used, and the various types of structure that may be employed in connection therewith.

Some of the valves and other devices connected to the well head 16 are unable to withstand the pressure either accidentally or intentionally placed on the well bore, as described above. Therefore, blowout preventer 20 is temporarily mounted on the well head 16 to prevent a blowout of these devices and valves.

Figure 2:
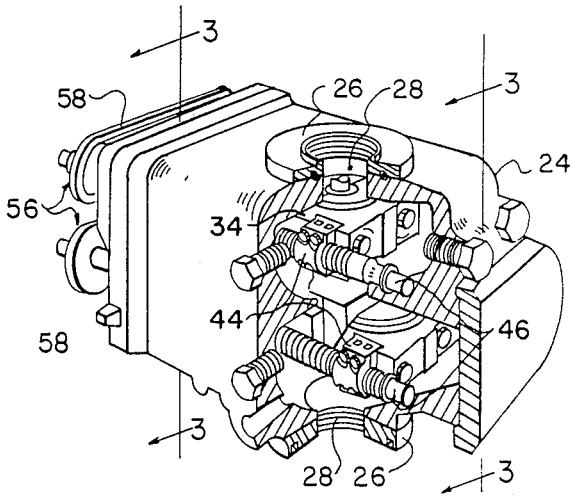
FIG. 2 is a perspective view of a blowout preventer with parts broken away, to show internal detail, as well as the position of split nuts according to my invention therein.
Figure 3:
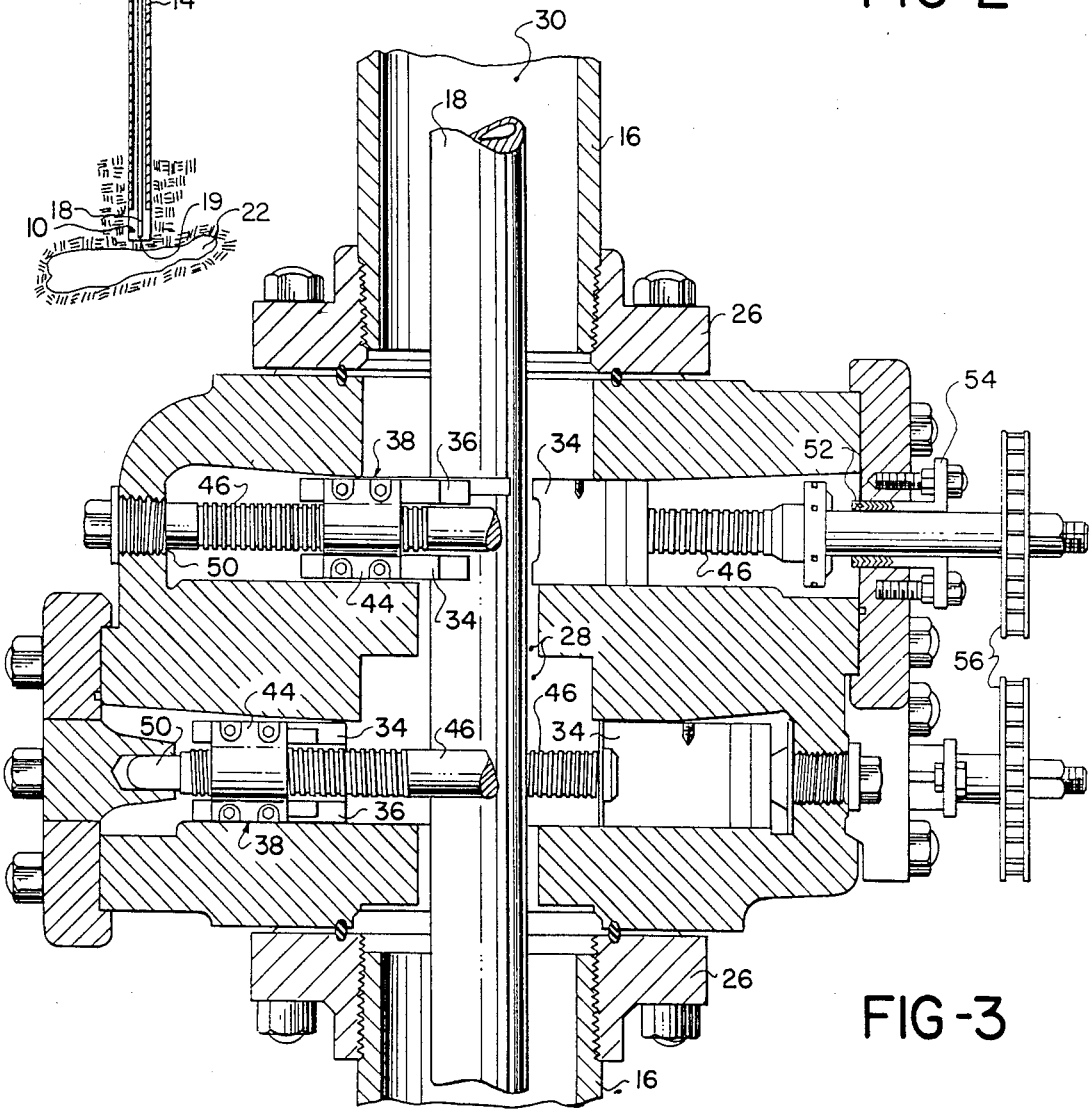
FIG. 3 is a side section view of the blowout preventer taken substantially along line 3—3 of FIG. 2.

Referring to FIGS. 2 and 3, the blowout preventer 20 includes preventer body 24, and flanges 26 for attaching the preventer 20 to the well head 16. Preventer bore 28 extends vertically through the preventer body 24, aligned with and fluid connected to well head bore 30.

Within the preventer body 24, carriages 34 are opposed on either side of the preventer bore 28, and horizontally slidably mounted within the preventer body. When the carriages are brought together about the tubing string, sealing surfaces 36 form a substantially fluid tight seal about the tubing string, blocking or sealing the preventer bore. When no tubing string is used the sealing surfaces are modified to use a blind (not shown) to completely block the preventer bore. Those with ordinary skill in the art are familiar with the use of the blinds for sealing the bore with blowout preventers of the type described.

Figure 4:
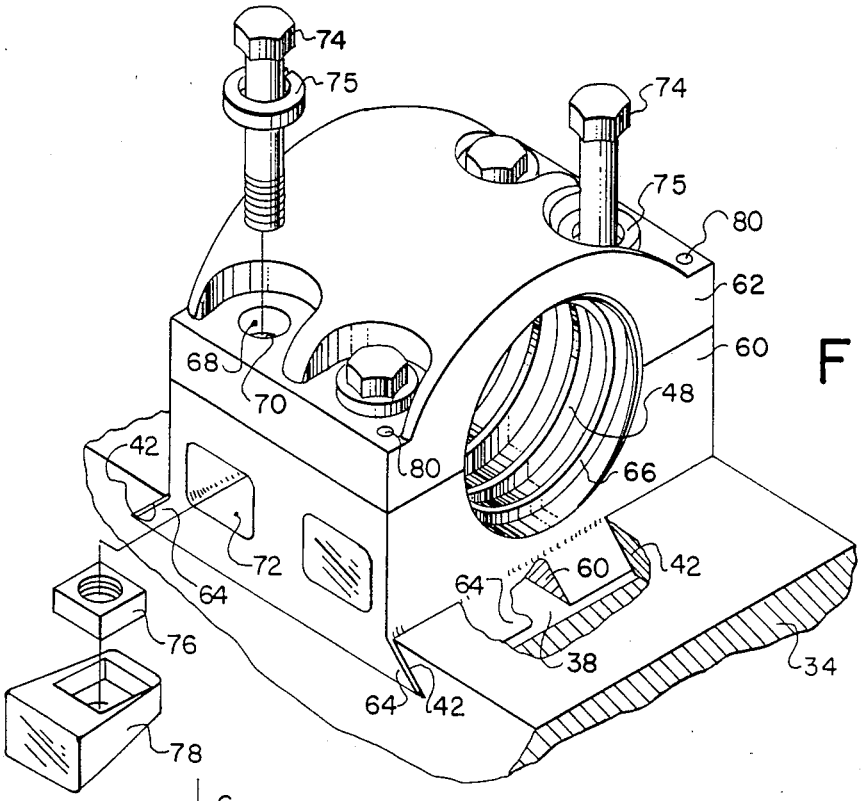
FIG. 4 is a perspective view of an improved split nut according to my invention.

As shown in FIG. 4, slots 38 in the side of each of the carriages 34 have slot ears 42. Split nuts 44 are engaged with the slot ears 42 at the slots 38. Actuating screws 46 extend through and threadably engage threads of nut bore 48 of each split nut 44. The slots 38 are each adjacent one of the actuating screws 46. The split nut has ends and sides extending between the ends. The nut bore 48 extends between the nut ends.

The actuating screws 46 are journaled to the body 24 at screw journals 50. The actuating screws 46 also extend from the preventer body, and are sealed against pressure by gland packing 52 and gland 54. Sprockets 56, mounted on the screws 46, are interconnected in pairs by chains 58. The sprockets and chains form a portion of drive means for rotating the screws 46.

The threaded bore 48 of each split nut 44 threadably engages the threads of the respective screw 46, such that when the screws 46 are rotated within the preventer body 24, the split nuts 44 will travel along the screws, and move the carriages 34 together and apart. Except for the split nuts 44 shown according to applicant's invention in FIGS. 2–7, the structure described above is well known in the blowout preventer art, and is not claimed by applicant as his invention. Applicant has shown the split nuts 44 according to his invention in FIGS. 2 and 3 to help the reader understand the limited, specific application of his invention.

Figure 5:
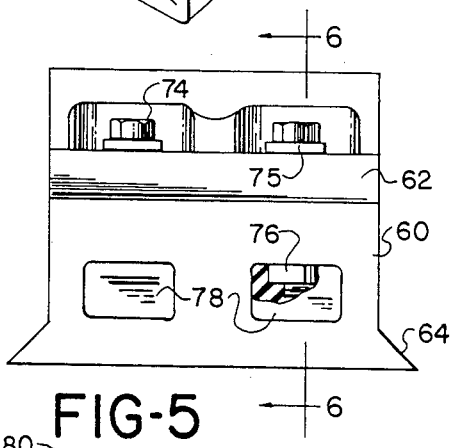
FIG. 5 is a side view of the split nut shown in FIG. 4.
Figure 6:
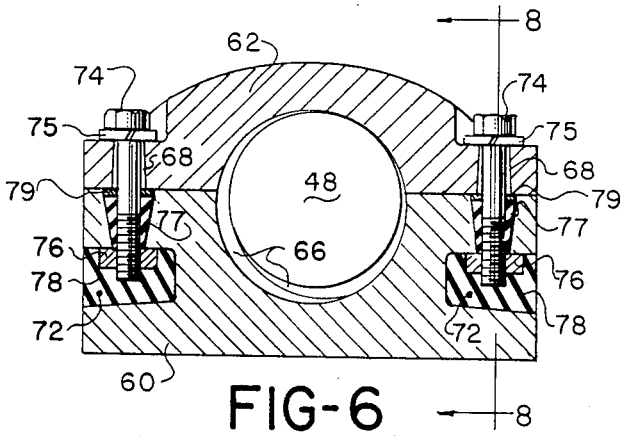
FIG. 6 is an end section view of the brass nut taken substantially along line 6—6 of FIG. 5.

Referring to FIGS. 4, 5, and 6, each of the nuts 44 may be seen to be preferably "split" into nut base 60 and nut cap 62. Nut flanges 64 preferably extend along a bottom of the base 60, transverse of the nut bore 48, and along the split nut ends. When the nut 44 is positioned in one of the slots 38, the nut flanges 64 are engaged by the slot ears 42, retaining the nut 44 on the carriage 34. Any slidable movement of the nut 44 within the slot 42 will be in a direction transverse of the threadable movement of the nut 44 and carriage 34 along the actuating screw 46. Threads 66 within the nut bore 48 are preferably cut in the brass cap 62 and base 60. Of course, the split nut or the threads 66 could be formed from a different metal alloy, so long as it is more ductile than the steel material from which the actuating screw is formed.

The cap 62 and base 60 each have a mating surface adapted to mate or join with the other mating surface to form the nut bore and a rigid, nut when fastened together. The mating surfaces are preferably flat, as shown in the drawings, but could be other shapes, or at angles to the bottom of the base 60, and still be within the scope of my invention.

The nut cap 62 has cap holes 68 extended therethrough. It will be understood that as described in connection with my invention, the nut cap may be either a single piece as shown in the preferred embodiment or may be a two-piece cap, such that a partial or complete slot extends through the cap along the split nut bore.

The preferred embodiment of the split nut according to my invention has base holes 70 extending through the base in alignment with the cap holes when the cap is positioned on the base to form the threaded nut bore. The base holes extend within the base to nut recesses 72 in the base. The recesses 72 extend from the split nut sides toward, but not to, the nut bore. Fastening bolts 74 extend through the cap holes 68 and base holes 70 into the recesses 72.

Fastening nuts 76 are positioned within the nut recesses 72, and are threaded onto the fastening bolts 74. Lock washers 75 around the bolts 74 are preferably used to prevent loosening of the tightened bolts. When cast in the cap, the cap holes are preferably tapered as shown in the drawings. When drilled, the cap holes may be straight bored.

The recesses 72 are sized so that the nut will be conveniently positioned therein, yet will not turn during threading of the bolt therethrough. Of course, it will be understood that the recesses could extend from any convenient position on the side or end of the nut so as to permit positioning of the fastening nuts in alignment with the cap and base holes. Thus, the fastening bolts 74, washers 75, and fastening nuts 76, in combination with the nut recesses 72, base holes 70, and cap holes 68 form fastening means for fastening the nut cap 62 to the nut base 60 to form the threaded nut bore 48 and the split nut 44. As described above, the nut cap 62 and nut base 60 are preferably made of brass, and the fastening nuts 76 and bolts 74 are preferably made of steel.

As described above, the prior art fastening means was comprised of fastening bolts extended through holes in the cap and into threaded holes within a nut base that did not have the recesses and fastening nuts disclosed by applicant.

The fastening nuts 76 could be designed to fail and release the fastening bolt 74 when subjected to a predetermined load. The failure point of such nuts may be determined with precision, providing for a more predictable fuze.

In accordance with my invention, it is also preferred to employ plugs 78, which are positioned in the recesses 72, and packing inserts 77, which are positioned in the base holes 70, to block the recesses and base holes, and isolate the threads of the fastener nuts and bolts from corrosive materials typically used in connection with reworking and other well operations.

Figure 7:
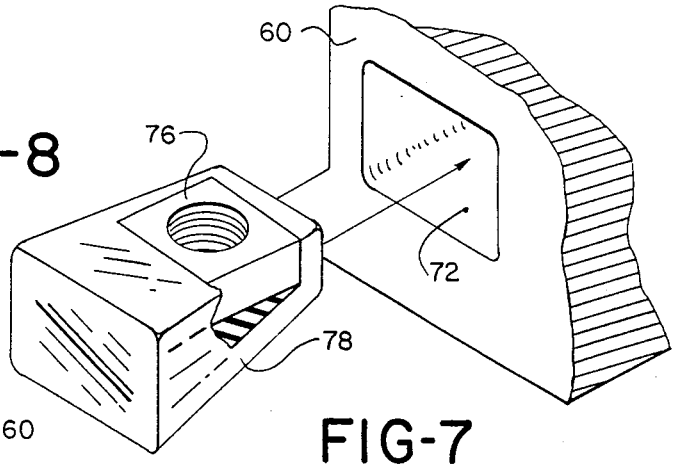
FIG. 7 is a perspective view of a plug and recess according to my invention with parts of the plug broken away to show the positioning of the nut.

It is preferred that the plugs 78 completely fill the recesses 72 to encase or encapsulate the fastening nuts 76, as shown in FIGS. 5, 6, and 7. The plugs 78 are preferably made of a rubber, epoxy, or plastic resin compound that will resist the corrosive effects of drilling materials, maintain a substantial seal of the recesses against entry of such corrosive materials therein, and maintain the fastening nuts 76 in aligned position for threadable engagement and tightening of the fastening bolts 74.

The plugs 78 may be easily removed by simply inserting a screw driver through the cap and base holes into the fastening nut and popping the plug out of the recesses. To facilitate easy removal, and to prevent the plug from being locked in the recesses, the plugs 78 and the recesses 72 are preferably tapered, as shown in the drawings. The recesses are preferably cast in the base. Because the shape of each recess will be different, it is preferred to initially pour epoxy into the recesses with the fastening nuts in the desired position to form a tight seal.

The base holes 70 are preferably of larger diameter than the cap holes 68, and tapered to receive the inserts 77. The base holes 70 may also be seen to have a depth from the base mating surface to the fastening nut 76. The inserts 77 are preferably formed of rubber or other resilient compound that will resiliently deform when compressed. The inserts 77 preferably fit tightly within the base holes 70 and about the fastening bolts 74, but not so tightly that the bolts 74 cannot be manually inserted through holes in the inserts 77 aligned with the cap holes and fastening nuts. The inserts may also be manually removed when the split nut is disassembled.

Figure 8:
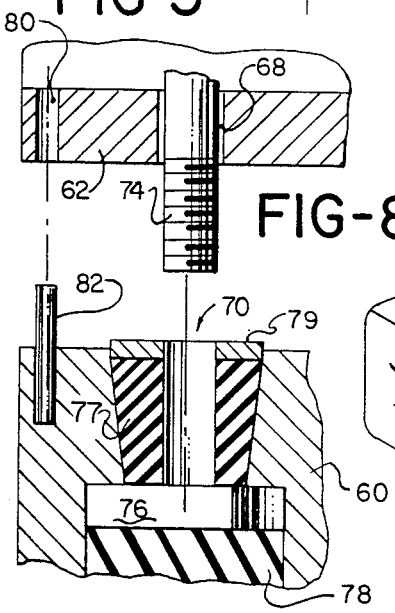
FIG. 8 is a section view of a portion of the split nut taken substantially along line 8—8 of FIG. 6.

Packing washers 79 are preferably used between the inserts 77 and the mating surface of the cap 62. The inserts 77 preferably have a thickness such that they are recessed below the mating surface of the base 60, as shown in FIG. 8. The washers 79 are preferably smaller in diameter than the base hole at the base 60 mating surface. The combined thickness of the packing washer 79 and the packing insert 77 is greater than the depth of the base hole 70, such that the washer 79 extends or protrudes from the base 60 when the split nut is disassembled, as shown in FIG. 8.

Thus when the cap 62 is placed on the base 60, the bolts 74 inserted through the cap holes and inserts, and threaded tightly onto the nuts 76, the inserts 77 will be compressed within the base holes 70 between the cap 62 mating surface and washers 79, and the tapered sides of the base holes and the fastening nuts 76. The compression of the inserts 77 serves to pack or seal the base holes 70 about the bolts 74 to further isolate the bolt 74 and nut 76 threads from corrosive materials. In other words, the washers 79 and inserts 77 form means for compressing the inserts within the base holes to seal the base holes from corrosive materials.

For ease in assembling the split nut 44, we prefer to have guide pins 82 at one of the ends of the base 70, and to drill aligned guide holes 80 in the cap 62, so that when the holes 80 are aligned with the pins 82, the cap holes 68 and the holes within the inserts 77 are aligned, and the threads 66 of the nut bore 48 are properly aligned and oriented at the mating surfaces of the cap 62 and base 60.

Thus, the preferred method of assembling the split nut 44 according to my invention proceeds substantially as follows. Plugs 78 with encapsulated fastening nuts 76 are formed by pouring epoxy into the recesses 72, with the nuts 76 in alignment with the base holes. As used herein, the words "insert" and "position" also refer to filling the pertinent recess or hole with liquid material that sets upon drying. The packing inserts 77, preferably with the packing washers 79 adhered thereto, are inserted into the base holes 70. The cap 62 is positioned over the base 60, and the guide pins 82 inserted into the guide holes 80. The fastening bolts 74, with lock washers 75 thereon, are inserted through the cap holes 68 and the inserts 77, and threaded into the fastening nuts 76 until tight, with the mating surfaces of the cap 62 and base 60 flush.

The embodiment shown and described above is only exemplary. I do not claim to have invented all the parts, elements, or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing the following catalog of elements is provided:

CATALOG OF ELEMENTS

10 well bore
12 ground surface
14 casing
16 well head
18 tubing string
19 well bore bottom
20 blowout preventer
22 reservoir
24 preventer body
26 flanges
28 preventer bore
30 well head bore
34 carriages
36 sealing surfaces
38 slots
42 ears
44 split nuts
46 actuating screws
48 nut bore
50 screw journals
52 gland packing
54 glands
56 sprockets
58 chains
60 nut base
62 nut cap
64 nut flanges
66 nut threads
68 cap holes
70 base holes
72 recesses
74 fastening bolts
75 washers
76 fastening nuts
77 packing inserts
78 plugs
79 packing washers
80 guide holes
82 guide pins

I claim as my invention:

1. An improved split nut for use in a blowout preventer on a well, a. said well including
b. a well bore extending downward within the earth and having a bore bottom,
c. a well casing extending downward within the well bore,
d. a well head atop the casing above ground surface,
e. said blowout preventer being installed on the well head, and including
f. a preventer body having a preventer bore therethrough, fluidly connected to the well bore,
g. opposed carriages horizontally slidably mounted within said preventer body,
h. at least one pair of threaded actuating screws journaled within the preventer body adjacent the carriages and the preventer bore,
i. a slot in each carriage adjacent one of the actuating screws,
j. ears adjacent each of the slots, and
k. each of said split nuts having
l. a nut base,
m. a nut cap,
n. a threaded nut bore adapted to threadably receive the actuating screw therethrough,
o. nut flanges extending from each nut base, adapted to slidably engage the slot ears when the nut base is positioned in the slot,
p. the carriages having sealing surfaces such that when the carriages are moved together, by rotation of the actuation screws, they sealably block the preventer bore;

WHEREIN THE IMPROVED SPLIT NUT FURTHER COMPRISES:

q. cap holes in the nut cap on either side of the nut bore,
r. base holes in the nut base aligned with the cap holes,
s. recesses in the nut base associated with the base holes,
t. fastening nuts positioned within the recesses in alignment with the cap and base holes,
u. fastening bolts extending through the cap and base holes into the recesses, and
v. the fastening bolts threaded into the fastening nuts to fasten the cap and base together.

2. The invention as defined in claim 1 including all of the limitations a. through v. with the addition of the following limitation:

w. plugs substantially sealing the recesses from corrosive materials.

3. The invention as defined in claim 1 including all of the limitations a. through v. with the addition of the following limitation:

w. plugs filling the recesses and sealably encasing the fastening nuts positioned therein.

4. The invention as defined in claim 1 including all of the limitations a. through v. with the addition of the following limitation:

w. packing inserts substantially sealing the base holes about the fastening bolts from corrosive materials.

5. The invention as defined in claim 4 including all of the limitations a. through w. with the addition of the following limitation:

x. plugs substantially sealing the recesses from corrosive materials.

6. The invention as defined in claim 1 including all of the limitations a. through v. with the addition of the following limitations:

w. resilient packing inserts within the base holes about the fastening bolts extended therethrough,
x. means for compressing said packing inserts within said base holes.

7. The invention as defined in claim 6 including all of the limitations a. through x. with the addition of the following limitations:

y. said means for compressing being
z. a packing washer around each of the fastening bolts between the cap and the packing inserts,
aa. the packing washers and the packing inserts being adapted to compress the packing inserts within the base holes responsive to tightening of the fastening bolts and fastening nuts.

8. The invention as defined in claim 6 including all of the limitations a. through x. with the addition of the following limitation:

y. plugs filling the recesses and sealably encasing the fastening nuts positioned therein.

* * * * *